US006102308A

United States Patent [19]

Steingass et al.

[11] Patent Number: 6,102,308

[45] Date of Patent: Aug. 15, 2000

[54] SELF-EDUCING NOZZLE

[75] Inventors: Robert Steingass, Valparaiso; David Kolacz, Plymouth, both of Ind.

[73] Assignee: Task Force Tips, Inc., Valparaiso, Ind.

[21] Appl. No.: 09/054,001

[22] Filed: Apr. 2, 1998

[51] Int. Cl.[7] ..... B05B 7/06

[52] U.S. Cl. ..... 239/424.5; 239/310; 239/424; 239/458; 239/423; 169/27

[58] Field of Search ..... 239/310, 318, 239/428.5, 428, 458, 417, 343, 423, 424, 425.5, 498, 505, 514, 422, 424.5; 169/15, 26, 27

[56] References Cited

U.S. PATENT DOCUMENTS

| | | | |
|---|---|---|---|
| 1,017,585 | 2/1912 | Pattin . | |
| 1,382,684 | 6/1921 | Shimper | 239/424.5 |
| 2,003,184 | 5/1935 | Friedrich . | |
| 2,513,417 | 7/1950 | Lindsay . | |
| 2,532,711 | 12/1950 | Goddard | 239/424 |
| 2,990,885 | 7/1961 | Brazier . | |
| 3,050,262 | 8/1962 | Curtis . | |
| 3,348,777 | 10/1967 | Hjulian . | |
| 3,387,791 | 6/1968 | Allenbaugh, Jr. | 239/458 |
| 3,533,559 | 10/1970 | Caird . | |
| 3,644,076 | 2/1972 | Bagge . | |
| 3,693,884 | 9/1972 | Snodgrass et al. . | |
| 3,741,484 | 6/1973 | Cresswell | 239/424 |
| 3,836,076 | 9/1974 | Conrad et al. . | |
| 3,863,844 | 2/1975 | McMillan | 239/458 |
| 3,893,624 | 7/1975 | Thompson . | |
| 4,061,248 | 12/1977 | Arena . | |
| 4,143,717 | 3/1979 | Gagliardo et al. . | |
| 4,213,936 | 7/1980 | Lodrick . | |
| 4,497,442 | 2/1985 | Williams | 239/424.5 |
| 4,505,431 | 3/1985 | Huffman . | |
| 4,525,175 | 6/1985 | Stellaccio . | |
| 4,640,461 | 2/1987 | Williams . | |
| 4,705,405 | 11/1987 | Williams . | |
| 4,781,467 | 11/1988 | Williams . | |
| 4,801,090 | 1/1989 | Yoshida et al. | 239/424 |
| 4,828,038 | 5/1989 | Williams . | |
| 5,012,979 | 5/1991 | Williams . | |
| 5,014,790 | 5/1991 | Papavergos . | |
| 5,090,619 | 2/1992 | Barthold et al. . | |
| 5,167,285 | 12/1992 | Williams et al. . | |
| 5,275,243 | 1/1994 | Williams et al. . | |
| 5,312,041 | 5/1994 | Williams et al. | 239/423 |
| 5,330,105 | 7/1994 | Kaylor . | |
| 5,575,341 | 11/1996 | Baker et al. . | |
| 5,678,766 | 10/1997 | Peck et al. | 239/424 |
| 5,779,158 | 7/1998 | Baker . | |
| 5,779,159 | 7/1998 | Williams et al. | 239/424.5 |
| 5,816,328 | 10/1998 | Mason et al. . | |

FOREIGN PATENT DOCUMENTS

| | | |
|---|---|---|
| 555644 | 1/1984 | Australia . |
| 0 099 626 A1 | 2/1984 | European Pat. Off. . |
| 0 099 626 B1 | 1/1987 | European Pat. Off. . |
| 0 399 646 A2 | 11/1990 | European Pat. Off. . |
| 0 429 736 A1 | 6/1991 | European Pat. Off. . |
| 0 505 100 A1 | 9/1992 | European Pat. Off. . |
| 0 608 140 A2 | 7/1994 | European Pat. Off. . |

OTHER PUBLICATIONS

Declaration of Kenneth Baker, Sep. 22, 1998, 10pgs.
Declaration of Harri K. Kytömaa, Oct. 5, 1998, 6pgs.
"The Williams '159 Patent is Anticipated by the Curtis '262 Patent," 23pgs.
Declaration of Jerome H. Marten, P.E., Dec. 23, 1998, 7pgs.
Declaration of Orville M. Slye, Jr., P.E., Sep. 21, 1998, 7pgs.
National Foam—Gladiator® Mid Range 500, 750 & 1000 GPM Foam/Water Nozzle, Mar. 1998, 4 pgs.
Butler & Binion, Jun. 16, 1998 Opinion Letter, 34 pgs.

*Primary Examiner*—Andres Kashnikow
*Assistant Examiner*—Dinh Q. Nguyen
*Attorney, Agent, or Firm*—Marshall, O'Toole, Gerstein, Murray & Borun

[57] ABSTRACT

A firefighting nozzle has a low-turbulence liquid flow channel that is directed outwardly by a baffle. Surrounding the flow channel is an annular concentrate chamber. The concentrate chamber leads from a concentrate inlet to a concentrate entry port on a rearward wall opposed to the baffle. Liquid flowing past the baffle draws concentrate through the concentrate entry port into the flow. The concentrate and liquid subsequently mix to produce fire-fighting foam.

13 Claims, 3 Drawing Sheets

SELF-EDUCING NOZZLE

BACKGROUND OF THE INVENTION

This invention relates to firefighting nozzles in which the liquid (usually water) is discharged through a circumferential passage and exits the nozzle in an annular (or "peripheral") jet flow, and more particularly to peripheral jet self-educing nozzles that use a constriction of the liquid channel within the barrel of the nozzle to draw a liquid chemical additive into the stream of liquid to produce a firefighting foam.

Many firefighting nozzles include a baffle at the end. The baffle includes a stem that extends through at least a portion of the barrel of the nozzle and is secured within the barrel by spokes. One popular line of self-educing foam nozzles, sold by Williams Fire & Hazard Control, Inc., utilizes the stem to add foam concentrate to the liquid flow. As described in U.S. Pat. No. 4,640,461, the Williams' nozzle diverts a portion of the stream of water flowing through the barrel of the nozzle into a flow passage within the stem. Foam concentrate is also supplied to the stem through a separate bore that extends through one of the spokes. This arrangement requires that both the stem and at least one of the spokes be wider than otherwise required.

The diverted flow of liquid entrains the concentrate mix within a mixing channel in the stem, and then strikes a deflector plate that is fastened to the downstream end of the baffle. The deflected mixture of liquid and concentrate mix then moves outwardly, and is impacted by another flow of water diverted away from the main flow. As the mixture continues to flow radially outwardly, it finally impacts the main flow as the main flow passes the baffle. Those skilled in the art have believed that the high turbulence provided in this arrangement is desirable for effective mixing of the chemical additives with the liquid flow to produce foam.

SUMMARY OF THE INVENTION

The applicants have found that effective foam production can be achieved in a less turbulent system that can provide a resulting jet spray with a longer reach.

Like all known self-educing nozzles, the applicants' nozzle has a liquid inlet, a chemical concentrate inlet, and an outlet. A liquid flow channel extends from the liquid inlet to the outlet, and a baffle is disposed within the liquid flow channel with a forward wall defining one part of the liquid flow channel. A connector on the liquid inlet allows the liquid flow channel to be placed in communication with a flow of water, while a separate connector allows the concentrate flow channel to be secured to a separate supply of chemical concentrate.

Unlike conventional self-educing nozzles, however, the flow of liquid through the nozzle is kept as smooth as possible. Rather than diverting a portion of the flow of water through a widened central stem and channeling concentrate through a widened spoke, both the central stem and the spokes are kept relatively small. Chemical concentrate first comes into contact with the flow of liquid through an annular concentrate entry port near the baffle. Concentrate reaches the entry port through an annular concentrate chamber that substantially surrounds the liquid flow channel. A suction is provided at the discharge of the nozzle on the entire circumference of the concentrate entry point, resulting in a discharge from the nozzle consisting of a concentrate-rich outer layer and a water-rich inner layer.

The nozzle has been found to be effective in producing foam, while the decreased turbulence in the flow through the barrel is believed to provide a jet with a better reach.

DETAILED DESCRIPTION OF THE DRAWING

Figure 1:
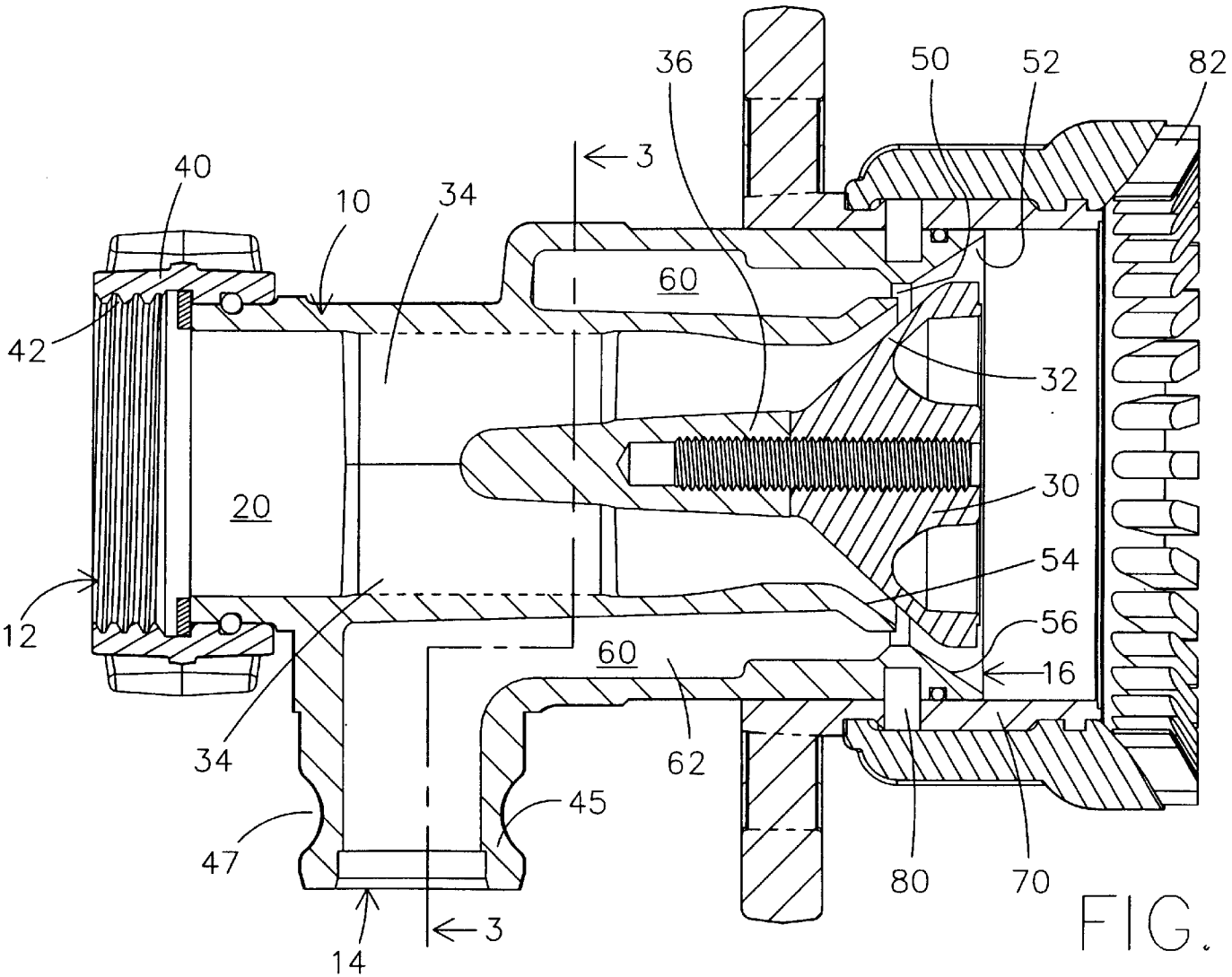
FIG. 1 is a side cross-sectional view of a self-educing nozzle in accordance with the present invention.
Figure 2:
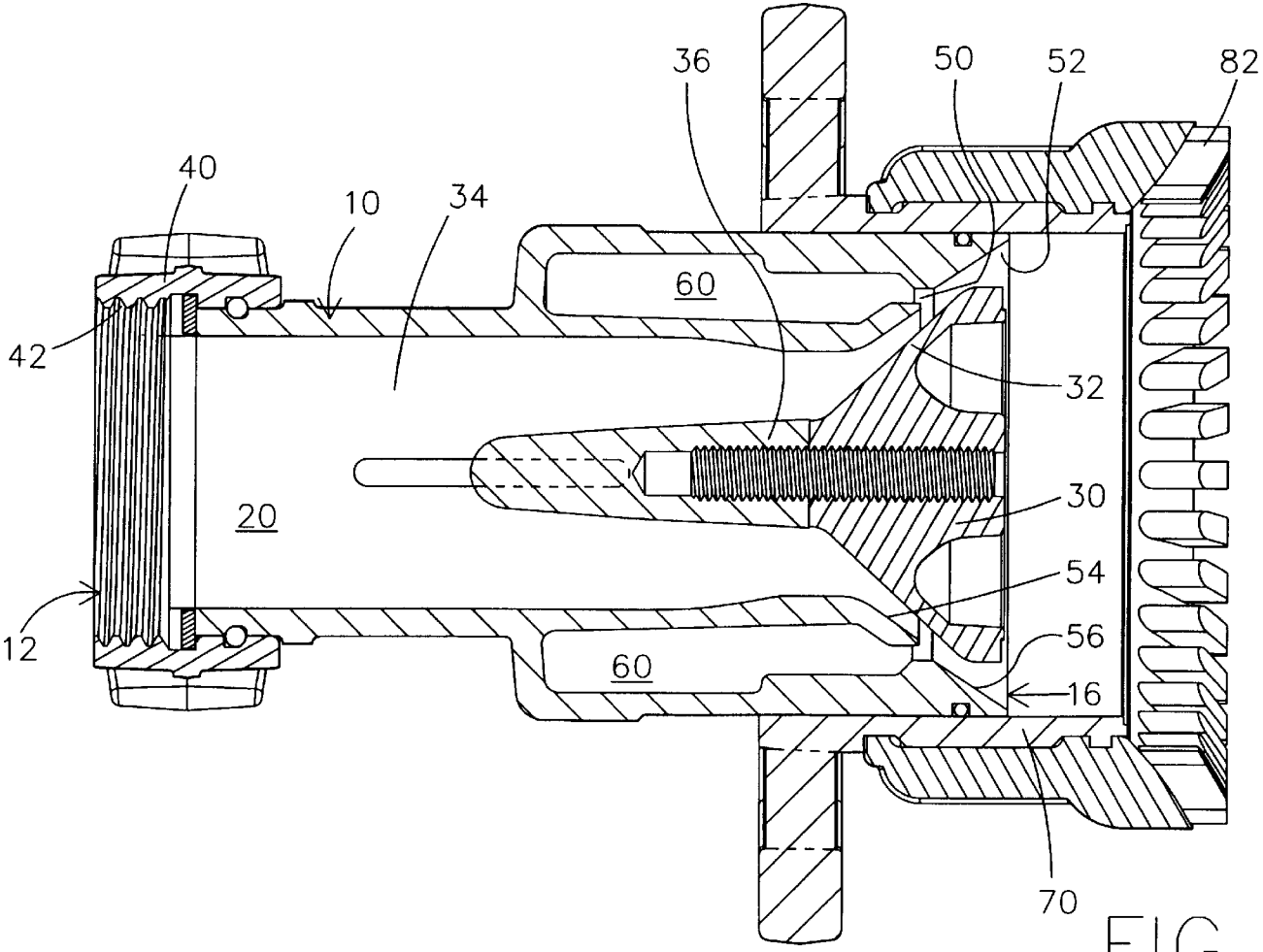
FIG. 2 is a top cross-sectional view of the nozzle.

FIGS. 1 and 2 illustrates one embodiment of a self-educing nozzle in accordance with present invention. Like conventional self-educing nozzles, the applicants' nozzle 10 has a liquid inlet 12, concentrate inlet 14, and an outlet 16. A liquid flow channel 20 extends from the liquid inlet to the outlet. A baffle 30 disposed within the liquid flow channel is used to shape the flow of the liquid exiting the outlet into an annular jet. To shape the flow, the baffle has a forward wall 32 that defines a part of the liquid flow channel.

Unlike baffles in some other self-educing nozzles, the illustrated baffle 30 does not include any internal flow channels or added deflection plates for increasing turbulence or mixing. As a result, the illustrated baffle can be manufactured more inexpensively and made more damage-resistant than other baffles commonly used in self-educing nozzles.

A coupling 40 on the liquid inlet allows the liquid flow channel to be placed in communication with a flow of water. The form of connection is not important to deriving the benefits of the invention, and thus any arrangement could be used. As is conventional, the illustrated coupling 40 is in the form of a rotatable collar with internal threads 42 that are designed to mate with external threads on a fire hose or monitor.

A separate concentrate coupling 45 allows a separate supply of concentrate to be connected to the nozzle. Again, the form of connection is not important to deriving the benefits of the invention, and any arrangement could be used. Here, the illustrated concentrate coupling takes the form of a male quick connection that is designed to mate with a female fitting and supply hose that is in flow communication with a separate chemical concentrate supply.

The baffle 30 is mounted within the flow channel 20 by spokes 34 projecting from a central stem 36. The stem is solid (that is, it does not include any functional internal flow passages) to minimize its outer dimensions and thus minimize the disturbance that the stem causes the flow of liquid through the flow channel 20. While the specific size of the stem will vary based on nozzle size and contemplated flow rates, the illustrated stem fills only about 10% of the flow channel area in the portion of the flow channel near the liquid inlet 12.

Figure 3:
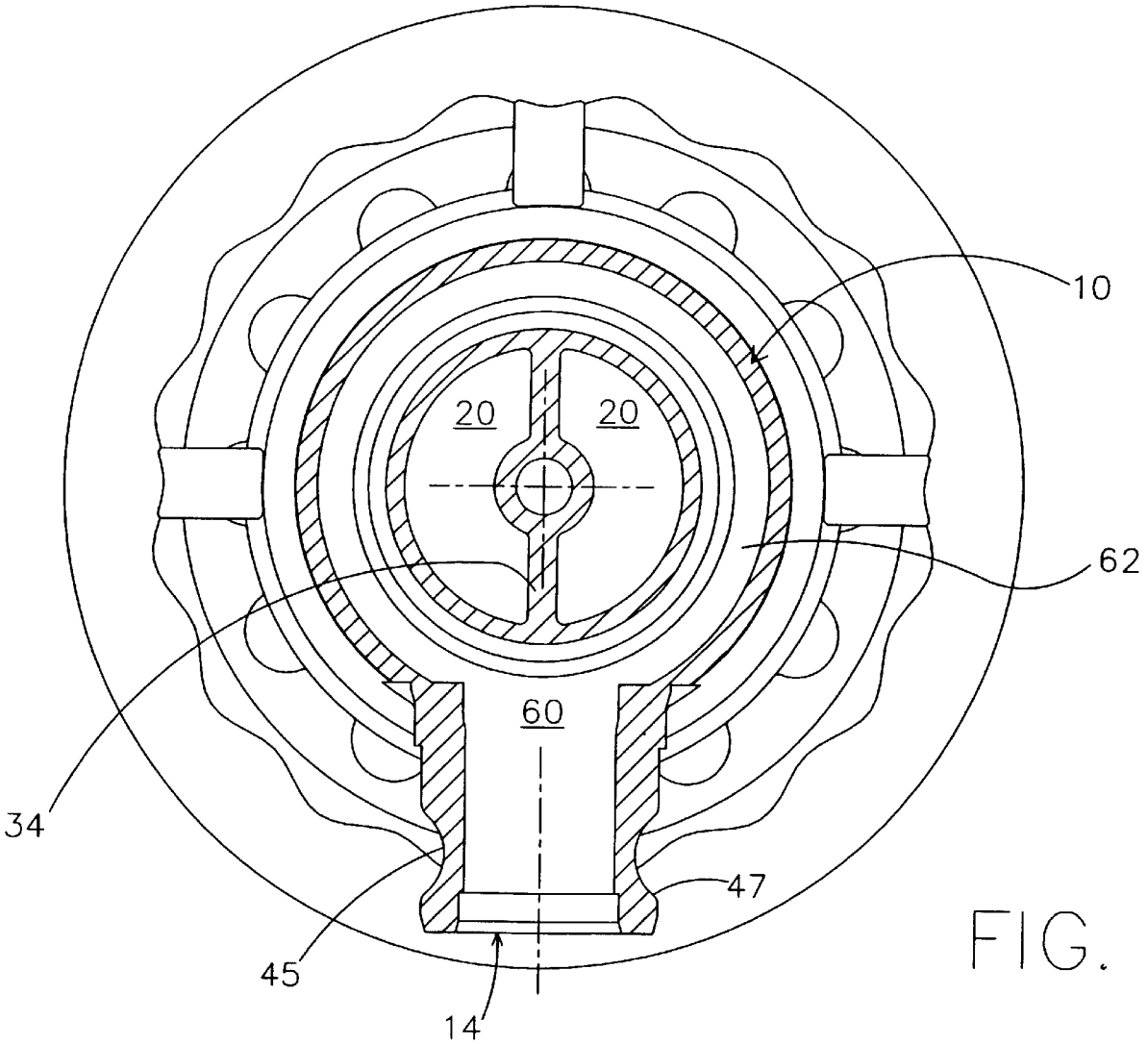
FIG. 3 is an axial view of the nozzle taken along lines 3—3 of FIG. 1.

The spokes 34 that are used to secure the central stem 36 are also designed to minimize disturbance to the flow of liquid through the flow channel 20. As seen in FIG. 3, the spokes occupy only about 10% of the area of that portion of the flow channel.

In the present invention, concentrate enters the liquid flow channel 20 through an annular entry port 50 on a rearward wall 52 opposite the forward wall 32 of the baffle 30. As illustrated, the rearward wall 52 is comprised of an upstream conical section 54 upstream of the entry port 50, and a downstream conical section 56 downstream of the entry port. While the dimensions of particular nozzles can of course vary, the forward wall of the baffle and the upstream conical section 54 in the illustrated embodiment constrict the liquid flow area by 60% or more, and are both similarly angled with respect to the central axis of the nozzle. This constriction in the liquid flow path has been formed to produce sufficient suction to draw concentrate into the liquid flow, as well as to develop the desired liquid discharge velocity to project the resulting jet great distances.

The configuration of flow channel 20 between the forward wall 32 and the upstream conical section 54 could be varied while the nozzle is in use by employing mechanisms such as those described in U.S. Pat. Nos. 3,539,112; 4,252,278; and 3,540,657.

In the illustrated embodiment of the invention, concentrate is added to the liquid flowing through the nozzle 10 at a point in the flow channel 20 where the flow channel is unitary; that is, where it is forms a single annular ring uninterrupted by spokes or divisions. Further, no other divisions of the flow path are encountered downstream of the entry port 50. While not necessary to obtaining benefits of the present invention, it is believed that the maintenance of a unitary flow path downstream of the entry port minimizes disturbance of flow of liquid and thus helps increase the reach of the resulting jet spray.

Each of the conical sections 54, 56 on the rearward wall 52 has a similar angle with respect to the axis of the nozzle (as illustrated, 35 degrees), and forward wall 32 is set at a slightly steeper angle than the rearward wall (as illustrated, 43 degrees). This results in the liquid flow being slightly directed into the downstream conical section 56, which is believed to increase the percentage of concentrate that can be educted. The downstream section 56 is offset radially outwardly with respect to the upstream section 54. As illustrated, the offset is approximately 20% of the distance between the rearward and forward walls. This offset provides an increased volume in the flow channel 20 to accommodate the addition of concentrate to the flow of liquid traveling through the flow channel.

The illustrated geometry is suitable for eduction of concentrate percentages up to about 20%, or viscosities up to about 30,000 centipoise. Lesser percentages can be obtained by restricting the flow of concentrate into the nozzle by orifice plates, regulating valves, or the like that have been calibrated to the viscosity and percentage desired. Concentrate may be fed to the nozzle from a remote pressurized source such as a metering pump. The energy required to drive the fluid need only be enough to overcome friction losses in the concentrate supply lines. Unlike in conventional self-educing nozzles, the foam concentrate is directed to the entry port 50 through a concentrate flow channel 60 that passes through an annular concentrate chamber 62 that substantially surrounds the liquid flow channel 20. In the preferred embodiment, the annular concentrate chamber completely surrounds the liquid flow channel and freely distributes concentrate uniformly to the entire circumference of the entry port 50. In this arrangement, the entry port communicates a uniform unitary layer of concentrate to the entire circumference of the flow path 20. The layer of concentrate enters the flow path smoothly and with minimal turbulence.

The illustrated nozzle 10 also includes a shaper 70 that may be adjusted axially between a forward position for producing a straight jet and a rearward position for producing a wide-angle spray, or at any desired intermediate setting. It has been found that when using a nozzle in accordance with this invention, the travel of the shaper required to change a wide-angle spray to a concentrated straight jet need only be about five times the distance between rearward wall 52 and forward wall 32 at the outlet 16, much less than commonly provided in conventional self-educing nozzles. It is believed that this results from the minimal turbulence inherent in the design of the present invention. The axial position of the shaper 70 may be adjusted by rotating the shaper along a helical cam groove 80. Other mechanisms for effecting axial adjustment of the shaper could also be used, including well-known mechanisms such as threads, hydraulic cylinders, electric actuators, linkages, and the like.

At the point of exiting the nozzle, the resulting peripheral jet is believed to comprise a foam concentrate-rich exterior layer and a water-rich inner layer in intimate contact with each other, and traveling together at substantially like velocity. Air inside of the peripheral jet is believed to be carried along with the peripheral jet as it projects outwards, resulting in reduced pressure inside the jet that in turn pulls outside air through the concentrate-rich layer in the jet and through the water-rich layer. Air pulling through these layers is believed to intermix the layers and form bubbles of firefighting foam. The formation of bubbles is believed to be greatly improved by having the concentrate-rich layer on the outside of the peripheral jet. Thus, the use in the present invention of outside air to mix the solution and form bubbles, (without increased turbulence within the nozzle) is believed to result in a jet that travels further than the jets developed by conventional nozzles.

The present invention may be used to educt, mix, and effectively discharge a variety of liquid additives, including thickening agents, fertilizers, soaps, bioremediation additives, and the like. The nozzle may also be used to effectively spray water without chemical additives, and the discharge of the nozzle may be fitted with various air-aspirating devices known to those skilled in the art, or with a series of end projections known as fog teeth 82 to produce angled spray patterns such as those whose advantages are described in U.S. Pat. Nos. 4,176,794 and 4,653,693. Because these devices generally improve the air-to-liquid expansion ratio of the foam at the expense of kinetic energy, use of such devices is likely to decrease the reach of the resulting jet.

Those skilled in the art will understand that these and other benefits of the invention can be derived in many different ways, and that many modifications can be made to the illustrated embodiment without departing from the scope of the invention.

We claim:

1. A self-educing peripheral jet nozzle comprising:

a liquid inlet, a concentrate inlet, and an outlet;

a liquid flow channel extending from the liquid inlet to the outlet;

an annular concentrate chamber that substantially surrounds the liquid flow channel;

means for securing the concentrate inlet to a supply of chemical concentrate;

a connection on the liquid inlet for securing the liquid flow channel in communication with a flow of water;

a baffle disposed within the liquid flow channel with an outwardly-extending forward wall forming one part of the liquid flow channel;

an outwardly-extending rearward wall forming an opposed part of the liquid flow channel; and a concentrate flow channel extending from the concentrate inlet to the concentrate chamber, and subsequently to a concentrate entry port on the rearward wall, across from the outwardly-extending forward wall on the baffle, the entry port providing the first point of contact between liquid from the liquid flow channel and concentrate in the concentrate flow channel.

2. A nozzle as recited in claim 1, in which the baffle is free of flow channels.

3. A nozzle as recited in claim 1, in which the rearward wall and the forward wall are in a section of the liquid flow channel where the liquid flow channel is unitary.

4. A nozzle as recited in claim 1, in which the rearward wall is comprised of an upstream conical section and a downstream conical section, each conical section having the same angle with respect to a common axis, and with the downstream section being offset radially outwardly with respect to the upstream section.

5. A nozzle as recited in claim 1, in which the forward wall of the baffle is set at a steeper angle with respect to a common axis than the rearward wall.

6. A nozzle as recited in claim 1, further comprising a shaper that can be adjusted between a forward position and a rearward position.

7. A nozzle as recited in claim 1, in which the nozzle includes means for changing the cross-sectional flow area of the liquid flow channel between the baffle and the rearward wall while the nozzle is in use.

8. A nozzle as recited in claim 7, where the means for changing the cross-sectional flow area of the liquid flow channel between the baffle and the rearward wall are adapted to automatically control the pressure of the liquid in the liquid flow channel.

9. A self-educing peripheral jet nozzle comprising:

a liquid inlet, a concentrate inlet, and an outlet;

a liquid flow channel extending from the liquid inlet to the outlet;

an annular concentrate chamber that substantially surrounds the liquid flow channel;

means for securing the concentrate inlet to a supply of chemical concentrate;

a connection on the liquid inlet for securing the liquid flow channel in communication with a flow of water;

a baffle disposed within the liquid flow channel with an angled forward wall forming one side of a constricted part of the liquid flow channel;

upstream and downstream conical sections across from the forward wall of the baffle and forming an opposed side of the constricted part of the liquid flow channel, each conical section being set at an angle shallower with respect to a common axis than the angle of the forward wall, and the downstream section being offset radially outwardly with respect to the upstream section; and a concentrate flow channel extending from the concentrate inlet to the concentrate chamber, and subsequently to a concentrate entry port between the conical sections, the entry port providing the first point of contact between liquid from the liquid flow channel and concentrate the concentrate flow channel.

10. A nozzle as recited in claim 9, in which the nozzle includes means for changing the cross sectional flow area of the liquid flow channel between the baffle and the conical sections while the nozzle is in use.

11. A self-educing peripheral jet nozzle comprising:

a liquid inlet, a concentrate inlet, and an outlet;

a liquid flow channel extending from the liquid inlet to the outlet;

an annular concentrate chamber that substantially surrounds the liquid flow channel;

means for securing the concentrate inlet to a supply of chemical concentrate;

a connection on the liquid inlet for securing the liquid flow channel in communication with a flow of water;

a baffle disposed within the liquid flow channel with an angled forward wall defining one part of the liquid flow channel;

a rearward wall defining an opposed part of the liquid flow channel and comprising a downstream conical section set at a lesser angle with respect to a common axis than the forward wall of the baffle; and a concentrate flow channel extending from the concentrate inlet to the concentrate chamber, and subsequently to an annular concentrate entry port on the rearward wall, the entry port providing the first contact between the liquid flow channel and the concentrate flow channel.

12. A nozzle as recited in claim 11 and further comprising means for changing the cross sectional flow area of the liquid flow channel between the baffle and the rearward wall while the nozzle is in use.

13. A nozzle as recited in claim 12, in which the means for changing the cross sectional flow area are adapted to automatically control the pressure in the liquid flow channel.

* * * * *